United States Patent [19]

Corallo et al.

[11] Patent Number: 4,666,039

[45] Date of Patent: May 19, 1987

[54] CASE FOR DOCUMENT BINDER

[75] Inventors: Gianbattista Corallo; Gilberto Domenici, both of Ivrea, Italy

[73] Assignee: Ing. C. Olivetti & C., S.p.A., Ivrea, Italy

[21] Appl. No.: 865,649

[22] Filed: May 16, 1986

Related U.S. Application Data

[63] Continuation of Ser. No. 688,597, Jan. 3, 1985, abandoned.

[30] Foreign Application Priority Data

Jan. 10, 1984 [IT] Italy ..... 52826/84[U]

[51] Int. Cl.[4] ..... B65D 85/00

[52] U.S. Cl. ..... 206/424; 206/45.34; 206/45.14; 206/425; 206/472; 280/45

[58] Field of Search ..... 206/44 B, 44.11, 45.14, 206/214, 215, 232, 424, 425, 449, 450, 472, 475, 45.34; 312/234, 290; 281/20, 45

[56] References Cited

U.S. PATENT DOCUMENTS

| | | | |
|---|---|---|---|
| 1,271,201 | 7/1918 | Muegge | 206/44 B |
| 1,726,684 | 9/1929 | Sollom | 281/20 |
| 2,176,183 | 10/1939 | Krieg | 206/425 |
| 2,258,666 | 10/1941 | Walker | 206/425 |
| 2,302,153 | 11/1942 | Spinner | 281/20 |
| 2,564,244 | 8/1951 | Bibler | 206/425 |
| 3,301,621 | 1/1967 | Stephson | 206/424 |
| 3,325,002 | 6/1967 | Bausch | 206/449 |
| 3,485,435 | 12/1969 | Greene et al. | 206/424 |
| 3,493,104 | 2/1970 | Tempelhof | 206/45.14 |
| 3,631,972 | 1/1972 | Gendron | 206/449 |
| 3,703,045 | 11/1972 | Nyman | 206/45.34 |
| 3,809,311 | 5/1974 | Fohrman et al. | 206/424 |
| 3,826,362 | 7/1974 | Staskus | 206/424 |
| 3,874,501 | 4/1975 | Cronheim | 206/425 |
| 4,012,087 | 3/1977 | Edwards, Jr. | 206/425 |
| 4,090,608 | 5/1978 | McCall | 206/424 |
| 4,225,038 | 9/1980 | Egly | 206/425 |
| 4,375,263 | 3/1983 | Dworkin | 206/44 B |
| 4,465,187 | 8/1984 | Kinard et al. | 206/425 |
| 4,488,644 | 12/1984 | Wynalda | 206/45.14 |

FOREIGN PATENT DOCUMENTS

| | | | |
|---|---|---|---|
| 2029361 | 12/1971 | Fed. Rep. of Germany | 206/425 |

*Primary Examiner*—Joseph Man-Fu Moy
*Assistant Examiner*—David T. Fidei
*Attorney, Agent, or Firm*—Banner, Birch, McKie & Beckett

[57] ABSTRACT

A transparent case (11) for a binder has a substantially parallelepiped form lacking one face and is made of transparent material. The lower support wall (17) of the case includes a wedge-shaped element (22) the sides of which project some millimeters inside the container. The sides (26, 28, 29) face the side walls (13, 14) of the case and are so connected as to spread the covers of the binder when it is introduced into the container. The wedge-shaped element (22) also has side faces (26, 27) parallel to the side walls (13, 14). The side faces (26, 27) space apart the binder covers so as to render them parallel and adjacent to the side walls (13, 14) of the container. This allows perfect viewing and reading of whatever writing or representation is on the covers of the binder and the best retention of the binder within the case, even when the binder contains few sheets.

3 Claims, 4 Drawing Figures

CASE FOR DOCUMENT BINDER

This application is a continuation of application Ser. No. 688,597, filed Jan. 3, 1985, now abandoned.

BACKGROUND OF THE INVENTION

The present invention relates to a case for a document binder, comprising a container of substantially parallelepiped form having opposed side walls, opposed top and bottom walls and being substantially without one wall to allow the passage into and accommodation within the container of a binder having two covers. The case is made, preferably, but not necessarily of transparent material.

In transparent cases of the kind mentioned, when the binder holds a limited quantity of sheets, the covers of the binder arrange themselves with the edges opposite the spine adjacent each other. The covers are as a result inclined relative to the side walls of the container, which results in difficulty in reading whatever is written and represented on the covers. Moreover, the retention of the binder within the container is insecure as a result. To avoid this, the user must employ a spacer for the two covers such as will hold the covers of the binder adjacent and hence parallel to the walls of the case. Such spacers can be of various materials, for example expanded plastics material or simply a thin card having a shape allowing introduction of the spacer into the binder before that is introduced into the case. This is obviously tedious for the user, who is forced to carry out laborious operations before and during the introduction of the binder into the case itself.

SUMMARY OF THE INVENTION

The case according to the present invention avoids this disadvantage, and is characterised in that the top or bottom wall of the container has an element projecting inside the container and of wedge-shaped outline for spreading the edges of the covers of the binder until the covers are disposed substantially parallel and adjacent to the side walls of the container.

BRIEF DESCRIPTION OF THE DRAWING

The invention will now be described, by way of example, with reference to the accompanying drawing in which.

DESCRIPTION OF THE PREFERRED EMBODIMENT

Figure 1:
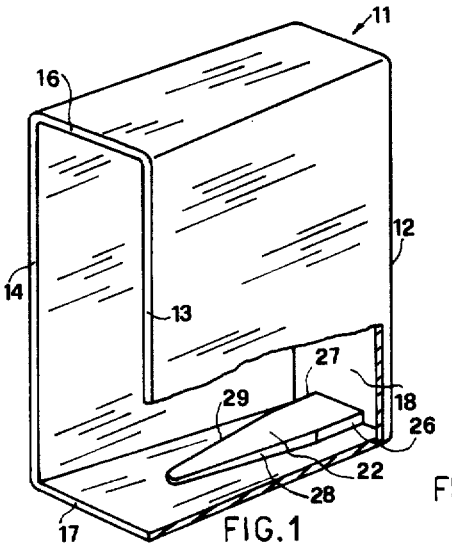
FIG. 1 is a partly sectioned perspective view of a case according to the invention.

With reference to FIG. 1, the binder case comprises a container 12 of transparent plastics material with a substantially parallelepiped shape. The container 12 comprises two parallel side walls 13 and 14, an upper wall 16 and a lower wall 17, the two being parallel, and an end wall 18. The front part is without a wall and allows passage into the container 12 of an ordinary binder 21 represented in chain dotted lines in FIG. 2. The lower wall 17 (FIG. 1) includes a wedge-shaped element 22 projecting some millimeters into the container 12 and provided with an outline suitable for guiding the edges of the two covers 23, 24 of the binder 21, (FIG. 2) to dispose these covers 23 and 24 substantially parallel and adjacent to the side walls 13 and 14 of the container 12. This allows perfect viewing and reading of whatever is written or represented on the covers 23 and 24 of the binder 21 and a good hold on the binder within the case to be achieved.

Figure 4:
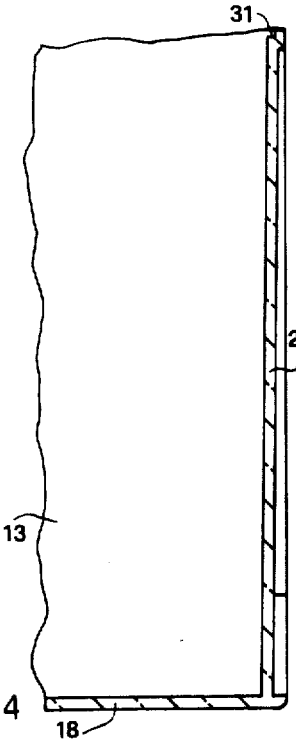
FIG. 4 is a partial lateral section of the case of FIG. 1.
Figure 3:
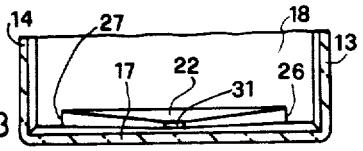
FIG. 3 is a partial section at the front of the case of FIG. 1.

The projecting wedge-shaped element 22 extends from the front wall 18 over a length substantially equal to two thirds of the length of the lower wall 17. The projecting element 22 has two side faces 26 and 27 which are parallel to one another and to the side walls of the container 12 and are contiguous with the front wall 18, and two faces 28 and 29 which are continuations of the faces 26 and 27 and converge towards one another so as to join at an end part 31 of substantially rounded form lying on the centre plane of the case, about which the faces 28 and 29 are symmetrical. As can be seen clearly from FIGS. 3 and 4, the wedge-shaped element 22 has a thickness measured perpendicular to the wall 17 which is smallest at the end part 31 and gradually increases up to the side faces 26 and 27, to provide better guidance for the lower edges of the covers 23 and 24 of the binder 21.

The spine 30 of the binder is so dimensioned as to engage the walls of the case with little play. However, when the binder 21 has a minimum of sheets, it has a tendency to dispose its covers 23 and 24 in inclined positions such that the edges opposite the spine 30 are adjacent. This results in the user having an inadequate view of whatever is written or represented on the covers 23 and 24. Furthermore the area of engagement between the parts of the covers near the spine 30 and the walls 13 and 14 of the case will be insufficient to ensure a good hold on the binder within the case itself.

Figure 2:
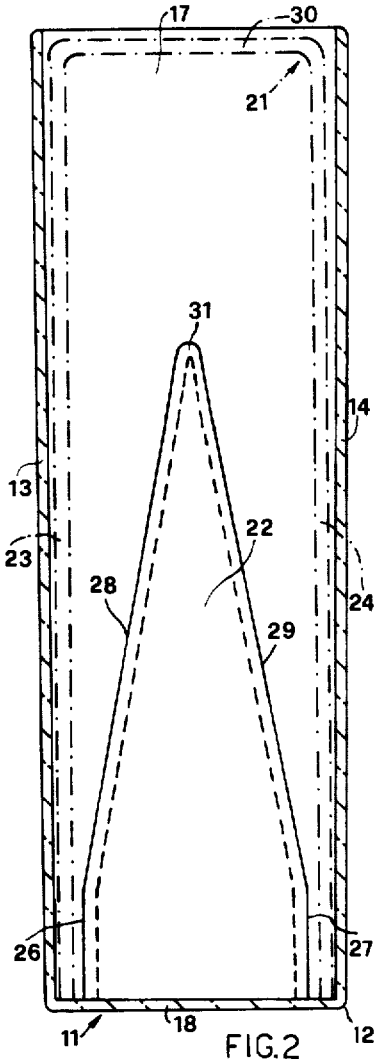
FIG. 2 is a partly sectioned plan view of the case of FIG. 1.

In accordance with the invention, the presence of the projecting wedge-shaped element 22 results in the lower edges of the covers 23 and 24, on encountering the end part 31, becoming suitably spaced apart when the binder 21 is introduced into the container 12. The converging parts 28 and 29 of the element 22 increasingly spread the covers 23 and 24 apart until, when the covers 23 and 24 engage the faces 26 and 27 they are disposed parallel and adjacent to the side walls 13 and 14 of the container 12. The element 22 has a sufficiently limited thickness not to interfere with the sheets held in the binder 21. When the covers 23 and 24 are in the position parallel to the walls 13 and 14, as represented in FIG. 2, the viewing and reading by the user of whatever is written on the covers 23 and 24 of the binder 21 is facilitated. Furthermore the area of engagement between the walls 13 and 14 and the binder covers 23 and 24 is increased and the hold on the binder within the case is maintained, even if the binder should contain few sheets and the spine 30 comes out of engagement with the walls 13 and 14.

It will be understood that modifications in and improvements to the form and to the arrangement of the various elements and parts can be made within the scope of the claims.

For example, instead of being solid, the wedge-shaped element can be formed by a double rib provided with sides facing the side walls and having the same function as the faces 28 and 29. The wedge-shaped element can alternatively or additionally be on the upper wall 16 of the container. Furthermore the case can have only some of its parts transparent, or can even by completely opaque.

We claim:

1. A case for a document binder comprising two covers and housing a series of document sheets, said case comprising a container of transparent plastic material in a single piece with substantially parallelepipedal shape having two parallel side walls, an upper wall, a lower wall opposite to said upper wall, and an end wall and being without one wall to define an aperture disposed opposite to said end wall; wherein the lower wall has a wedge-shaped step projecting into the container, said wedge-shaped step extending from the end wall integral with the lower wall and the end wall and comprising two side faces parallel therebetween and to the side walls and contiguous with said end wall, two inclined faces which are continuations of the side faces and converge towards one another so as to join at an end part of substantially rounded form, wherein said end part lies on a centre plane of the case, about which said inclined faces are symmetrical, wherein the wedge-shaped step has a length substantially equal to two-thirds of the length of the lower wall and has a thickness measured perpendicular to the lower wall which is smallest at the end part and gradually increases along the side faces up to a height insufficient to cooperate with the lower edges of the series of document sheets, but sufficient to cooperate with and guiding two lower edges of the two covers, wherein said document binder may be housed in the container through said aperture in order to cause the corresponding lower edges of said two covers to engage with said end part to become suitably spaced apart, with said inclined faces which spread two covers apart and successively with said side faces which hold the covers apart until the covers are disposed substantially parallel and adjacent to the side walls of the container to allow perfect viewing and reading of whatever is written or represented on said two covers of the document binder independently of the number of said document sheets held in said binder.

2. A case for a document binder of the type comprising a spine and two covers and housing a series of document sheets, wherein the covers of said document binder have lateral edges opposite to the spine and lower edges which project a little from lower edges of the document sheets and wherein said covers may assume an inclined disposition in which said lateral edges are adjacent in the case of a low number of sheets, said case comprising a container of transparent plastic material in a single piece with substantially parallelepipedal shape having two parallel side walls dimensioned to be engaged by said spine with little play, an upper wall, a lower wall opposite to said upper wall, and an end wall and being without one wall to define an aperture disposed opposite to said end wall and wherein said lower wall has a wedge-shaped step projecting inside the container for engaging the lower edges and guiding the lateral edges:

said wedge-shaped step extending from the end wall integral with the lower wall and the end wall and comprising two side faces parallel therebetween and to the side walls and two inclined faces which are continuations of the side faces and converge towards a common edge substantially perpendicular to said lower wall and centered with respect to said side walls;

wherein said document binder may be housed in the container through said aperture;

wherein said wedge-shaped step is configured in such a manner that upon introduction of the binder through said aperture, the lateral edges and the lower edges of said two covers in said inclined disposition cooperate with the common edge which diverts the two covers and successively with the inclined faces which spread the covers and at last with the side faces of said wedge-shaped step which hold said covers apart until the covers are disposed substantially parallel and adjacent to the side walls of the container to allow perfect viewing and reading of whatever is written or represented on said two covers of the document binder independently of the number of said document sheets held in said binder; and wherein said wedge-shaped step has a sufficiently limited thickness not to interfere with the lower edges of said series of document sheets.

3. A case for a document binder comprising a spine and two covers and housing a series of document sheets, said case comprising a container of substantially parallelepipedal shape having two parallel side walls, an upper wall, a lower wall opposite to said upper wall, an end wall and being without one wall to define an aperture disposed opposite to said end wall; wherein the lower wall has a wedge-shaped step projecting into the container for a thickness sufficient to cooperate with lower edges of the two covers, but insufficient to interfere with the document sheets, said wedge-shaped step extending from the end wall over a length substantially equal to two-thirds of the length of the lower wall and comprising two side faces parallel to one another and to the side walls and contiguous with the end wall, and two inclined faces adjacent to said side faces and converging towards a common edge, wherein said document binder can be housed in the container through said aperture and wherein the presence of the wedge-shaped step results in the lower edges of the two covers, on encountering the common edge, which diverts the two covers when the document binder is introduced into the container, wherein the inclined faces spread the two covers apart, when the two covers engage the side faces which hold the two covers apart and the covers are substantially parallel and adjacent to the side walls of the container independently of the number of said document sheets held in said binder when the spine of the document binder reaches said aperture.

* * * * *